US005822739A

United States Patent [19]

Kara

[11] Patent Number: 5,822,739

[45] Date of Patent: Oct. 13, 1998

[54] SYSTEM AND METHOD FOR REMOTE POSTAGE METERING

[75] Inventor: Salim G. Kara, Houston, Tex.

[73] Assignee: E-Stamp Corporation, Houston, Tex.

[21] Appl. No.: 725,119

[22] Filed: Oct. 2, 1996

[51] Int. Cl.[6] ..... G07B 17/00

[52] U.S. Cl. ..... 705/410; 235/375; 235/381; 340/825.35; 705/401

[58] Field of Search ..... 235/375, 380, 235/381; 364/464.11, 464.13, 464.18, 464.2; 380/23, 51; 340/825.31, 825.33, 825.34, 825.35; 705/401, 403, 408, 410

[56] References Cited

U.S. PATENT DOCUMENTS

| | | | |
|---|---|---|---|
| 4,253,158 | 2/1981 | McFiggans | 380/23 |
| 4,376,299 | 3/1983 | Rivest et al. | 380/23 |
| 4,641,347 | 2/1987 | Clark et al. | 380/3 |
| 4,725,718 | 2/1988 | Sansone et al. | 235/495 |
| 4,743,747 | 5/1988 | Fougere et al. | 235/494 |
| 4,757,537 | 7/1988 | Edelmann et al. | 380/51 |
| 4,763,271 | 8/1988 | Field | 364/466 |
| 4,775,246 | 10/1988 | Edelmann et al. | 380/23 |
| 4,800,506 | 1/1989 | Axelrod et al. | 364/478 |
| 4,802,218 | 1/1989 | Wright | 380/23 |
| 4,812,994 | 3/1989 | Taylor et al. | 364/464.02 |
| 4,831,554 | 5/1989 | Storace et al. | 364/464.13 |
| 4,831,555 | 5/1989 | Sansone et al. | 364/519 |
| 4,837,701 | 6/1989 | Sansone et al. | 364/464.14 |
| 4,858,138 | 8/1989 | Talmadge | 364/464.18 |
| 4,864,618 | 9/1989 | Wright et al. | 380/51 |
| 4,868,757 | 9/1989 | Gil | 364/464.03 |
| 4,900,903 | 2/1990 | Wright et al. | 235/380 |
| 4,900,904 | 2/1990 | Wright et al. | 235/381 |
| 4,901,241 | 2/1990 | Schneck | 364/464.02 |
| 4,908,770 | 3/1990 | Breault et al. | 364/464.14 |
| 4,941,091 | 7/1990 | Breault et al. | 395/230 |
| 5,065,000 | 11/1991 | Pusic | 235/381 |
| 5,111,030 | 5/1992 | Brasington et al. | 235/375 |
| 5,202,834 | 4/1993 | Gilham | 364/464.14 |
| 5,239,168 | 8/1993 | Durst, Jr. et al. | 235/432 |
| 5,319,562 | 6/1994 | Whitehouse | 364/464.03 |
| 5,423,573 | 6/1995 | de Passillé | 283/71 |
| 5,583,779 | 12/1996 | Naclerio et al. | 364/464.18 |
| 5,606,613 | 2/1997 | Lee et al. | 380/21 |
| 5,655,023 | 8/1997 | Cordery et al. | 380/51 |
| 5,696,829 | 12/1997 | Cordery et al. | 380/55 |

FOREIGN PATENT DOCUMENTS

| | | |
|---|---|---|
| 0137737 | 9/1984 | European Pat. Off. . |
| 2580844 | 4/1986 | France . |
| 2251210 | 12/1990 | United Kingdom . |
| 8801818 | 3/1988 | WIPO . |

*Primary Examiner*—Edward R. Cosimano
*Attorney, Agent, or Firm*—Fulbright & Jaworski L.L.P.

[57] ABSTRACT

A system and method for remote postage metering of postage indicia, including demanding a desired postage amount and subsequently printing the postage indicia onto a piece of mail. A user inputs certain necessary information, as well as additional desired information, into a local processor-based system. The local system then assembles a postage demand in suitable format and transmits the same to a remote postage metering device. The remote postage metering device then verifies the demand for authority to demand and valid funding. Upon verification, the remote postage meter assembles a data packet representing an authorized postage indicia. The data packet is transmitted to the local system for printing. Printing of the postage indicia may be unaccompanied, or may include additional information. Such additional information may include destination and return address, machine readable routing or identification information, or a complete document to be posted.

63 Claims, 3 Drawing Sheets

SYSTEM AND METHOD FOR REMOTE POSTAGE METERING

REFERENCE TO RELATED APPLICATIONS

The present application is being concurrently filed with U.S. application Ser. No. 08/729,669, entitled "SYSTEM AND METHOD FOR DETERMINATION OF POSTAL ITEM WEIGHT BY CONTEXT" and U.S. application Ser. No. 08/727,833, entitled "SYSTEM AND METHOD FOR RETRIEVING POSTAGE CREDIT CONTAINED WITHIN A PORTABLE MEMORY OVER A COMPUTER NETWORK," each having a common assignee, which applications are hereby incorporated by reference.

TECHNICAL FIELD OF THE INVENTION

This invention relates, in general, to a system and method, under the control of general purpose computers, for transmitting an amount of authorized postage to a demanding processor-based system, and the subsequent imprinting of that transmitted postage on an item of mail. More specifically, the invention relates to a postage metering system that allows coupling a plurality of remotely located processor-based systems to a centralized metering device, by means of a publicly accessible gateway, whereby non-fungible postage is communicated from the metering device to specific ones of the plurality of remotely located processor-based systems.

BACKGROUND OF THE INVENTION

Presently, it is common for individuals or businesses to have residing within their offices a postage meter rented from a commercial supplier. This arrangement is very convenient, since letters may be addressed, postage applied, and mailed directly from the office without requiring an employee to physically visit the United States Post Office and wait in line in order to apply postage to what is often a quite significant volume of outgoing mail, or to manually apply stamps to each piece of mail in which case mail is slower because it has to go through a postage canceling machine.

Quite naturally, postage meters were developed to relieve the manual application of stamps on mail and to automate the above process. Nevertheless, a postage meter residing within an office is not as convenient and efficient as it may first seem to be. First, a postage meter may not be purchased, but must be rented. The rental fees alone are typically over twenty dollars per month. For a small business, this can be quite an expense to incur year after year. Second, a postage meter must be adjusted, serviced and replenished manually; e.g., each day the date must be adjusted manually, periodically the stamp pad must be re-inked, and when the amount of postage credit programmed within the postage meter has expired, the postage credit must be replenished. To be replenished, a postage meter must be manually unplugged, placed into a special case (the meter is of a significant weight), and taken to a United States Post Office to have the meter reprogrammed with additional postage credit. Upon arrival at the United States Post Office, a teller must cut the seal, replenish the meter with a desired amount of postage credit, and reseal the meter. The meter must then be returned to the office and powered up.

A slightly more expensive meter (rental of approximately $30.00 more) works in the following manner: 1) a user sets up an account with the meter supplier, 2) 7 to 10 days before a user requires any postage, the user deposits with the meter owner the amount of postage required, 3) the user then calls the owner (7 to 10 days later) and they issue instructions as to the manual pushing of a variety of buttons on the meter (programming) which will replenish the postage amount on the meter. Nonetheless, the meter must be taken to the Post Office every 6 months.

Thus, in addition to the monthly rent, the servicing and replenishing of the meter requires the time and expense of at least one employee to take the meter to the United States Post Office to have it checked. Of course, this procedure results in down-time wherein the postage meter is not available to the business for the application of postage to outgoing mail. In addition, because of the monthly rent and the size of these devices, it is generally not practical for businesses to have more than one postage meter to alleviate this down-time.

A more recent solution to postage metering is disclosed in U.S. Pat. No. 5,510,992 entitled SYSTEM AND METHOD FOR AUTOMATICALLY PRINTING POSTAGE ON MAIL, assigned to Post N Mail, L. C., Houston Tex., and is hereby incorporated by reference. There, the disclosed metering system provides for the sale of postage credit on portable processor devices to be later utilized as needed. However, such a system, although considerably more convenient than the traditional metering systems discussed above, still requires the prepurchase of postage credit in order to be available at the time of generating a postage indicia.

The alternative to a postage meter and its associated prepurchased postage credit to a business, especially a small business, is to forego the advantages of a postage meter and to buy sheets, or books, of stamps. Without a doubt, this is not a sufficient solution. A variety of denominations of stamps are generally required since applying two 32¢ stamps to a letter requiring only 40¢ will add up over time. Additionally, it is difficult for a business to keep track of stamp inventories, and stamps are subject to pilferage and degeneration from faulty handling. Moreover, increases in the postal rate (which seem to occur every three years) and the requirement for variable amounts of postage for international mail, makes the purchase of stamps even more inefficient and uneconomical.

Because of different postage zones, different classes of mail, different postage required by international mail and the inefficiency of maintaining stamps within an office, it is important to have an automatic postage system, such as the aforementioned inefficient and relatively expensive postage meter.

A need in the art therefore exists for a system and method that provides the correct amount of authorized postage on demand at locations other than a United States Post Office, while avoiding the use of a traditional postage meter or the use of any supply of postage credit at the demand site. Moreover, there is a need in the art for a system and method which allows the substantially instantaneous affixing of this authorized postage upon an item of mail after demand.

It is, therefore, advantageous for the provision of postage credit to be transmitted to demanding locations by a substantially automated system and method. Furthermore, any such system and method needs to maintain strict controls on the issuing of such indicia. These controls may provide verification of a request for postage so as to expose any rogue postage requests.

Additionally, it would be advantageous for any processor-based system providing postage metering requests and subsequent imprinting to interface with a user friendly operating environment that is flexible and which can be coupled to other programs such as word processing, spreadsheet, accounting, database, or graphics programs.

SUMMARY OF THE INVENTION

The present invention addresses the above-described problems of providing postage credit by providing a postage metering system and method whereby the metering of the postage, i.e., the assessing of payment and authorizing of postage, is accomplished at a remote location allowing access to a plurality of processor-based systems demanding postage. The postage demands are verified to ensure such demands are authorized to receive indicia of postage to be funded in accordance with the demand.

It will be appreciated that a technical advantage of the present invention is that a user can easily demand, fund, receive and print postage indicia from a processor-based system that does not include a postage metering device. A further technical advantage is that provision of postage indicia by the present invention is accomplished nearly instantaneously, thereby providing postage on demand.

Provision of postage indicia according to the present invention is substantially automated, thus requiring a minimum of operator involvement in the transmittal of postage credit. Furthermore, substantial automation in assessing the amount of postage required, as well as demanding, funding, receiving and printing postage indicia, results in a similar reduction in user involvement in utilizing the invention.

Further technical advantages are realized by the inclusion of encrypted data within, or accompanying postage indicia printed as a result of the present invention. Such advantages include the ability to identify rogue use of such postage indicia as well as both the metering and printing sites utilized with a particular postage indicia. Furthermore, by including a POSTNET bar code, a reduction in postage may be realized. Thus, use of the remote postage meter system is not only more convenient than a conventional postage meter but it can also save the user money on postage.

Technical advantages are realized by the communication of postal information associated with the demand for postage. In addition to the above mentioned advantage of lower postage costs by the inclusion of a communicated zip code as POSTNET bar coding accompanying the indicia, addressee information communicated to the remote metering device may advantageously be verified or corrected at the metering device. By transmitting the destination address of the postal item for which the indicia is to be generated, the remote metering device may verify or change the address to a format suitable for use by the issuing authority prior to its application on a postal item. Furthermore, omitted or erroneous information, such as zip code information, could be supplied or verified.

These and other needs and advantages are met in a preferred embodiment of the present invention in which a first processor-based system (PC) is located within a business' office or an individual's home. The first PC stores a program, hereinafter referred to as the "Demand" program, accepts information from a user, a coupled device, or the context in which the postal item is being created or sent regarding the amount of desired postage and the mail piece for which it is needed. The demand program subsequently makes a demand for postage to a remote postage meter. The remote postage meter, itself a second processor-based system in the form of a PC, is located at a postage provider's office or other central source. The second PC stores a program, hereinafter referred to as the "Meter" program, which verifies postage demands and electronically transmits the desired postage indicia to the first PC in the form of a data packet. For security purposes, the data packet may be encrypted, or may include information allowing its use only by a selected Demand program, such as the Demand program actually demanding the postage. Subsequently, the Demand program receives the data packet and prints postage indicia, designating the appropriate amount of postage on a printer or special purpose label-maker coupled to the first PC. The postage indicia may contain encrypted information, such as transaction identification, the sender's and/or recipient's address or the Meter and/or Demand program serial number, to be utilized by the postal service for security or other purposes. The Demand program interfaces with the user through the display screen and an input device, such as a keyboard, or mouse. The data packet could contain the indicia for printing with a specific Demand program or it may contain data which allows the Demand program to generate its own indicia.

The Demand program may be coupled to a word processing program, or other process, residing within the first PC, thus allowing the user to request and subsequently print the postage indicia on correspondence or postal items generated by the coupled process. In such an arrangement, the Demand program may utilize information from the coupled process to determine a correct amount of postage from the context of the correspondence, such as size or weight of paper, draft or correspondence mode, etcetera. Additionally, the Demand program may be programmed to independently print a destination address and return address in addition to the postage indicia to be printed on an item of mail. Thereafter, an item of correspondence bearing the postage indicia can be placed in envelopes with cutouts or glassine paper at the appropriate areas so that the address, return address, and/or postage indicia can be visualized through the envelope In the preferred embodiment, the Demand program provides security at the demand site to prevent unauthorized utilization of the postage metering system. The appropriate level of security for any installation of the Demand program can be chosen by a principal at each location, thereby providing a distributed security system. Distributed security provides the ability for individual users of the postage metering system to select a level of security appropriate to prevent postal theft in their environment. Such distributed security does not increase the risk of postage loss at the remote meter as, regardless of the level of security chosen at the demand site, verification is performed by the Meter program to ensure each demand is valid and properly funded.

In addition, the Demand program can be used to transmit a variety of information to be encoded by the Meter program within the postage indicia using symbol technology. Such information is machine readable and can be used to identify postage indicia forgeries. The Demand or Meter programs may also encode a variety of information into a bar code that may be printed separately from the postage indicia. For example, the Demand program could automatically produce a "partial" indicia, such as zip+4 to be printed on the postal item. The remote Meter program will then, by knowing what the Demand program has produced or will produce, generate the remainder of the indicia to match this partial indicia. Thus, any attempt to intercept the indicia transmitted from the Meter program will result in a partial or mismatched indicia printed by the interceptor.

Provision of postage indicia by the remote meter of the present invention may also be utilized to provide anonymous postage. The Meter program may be programmed to issue authorized postage wherein the postage indicia ultimately printed does not include any identification of the demanding system. Although the United States Postal Service (USPS) currently requires postage meter identification on postage indicia, the remote metering system may be utilized to provide anonymity as the required meter identification may indicate the remote postal meter rather than any individual's postal meter.

An added advantage of the remote meter is that it may be utilized to provide postal address checking. A database of current postal addresses may be maintained at the remote meter site and utilized by the Meter program to verify the current address when postage is demanded. The dynamic nature of a current postal address database makes it inefficient to maintain such a database local to the user, but the centralization of the information allows the use of such a database more economically.

In the preferred embodiment, the Demand program is able to automatically calculate the correct postage to place on a letter, parcel or label as a function of the class, zone and weight of the particular item to be mailed. Alternatively, the Meter program is able to automatically calculate the correct postage from information contained within the demand. Also, a balance may be coupled to the first PC so that mail can be placed on the balance and the weight of the mail automatically entered into the Demand program for calculating the correct postage for that mail item. These calculations can be made locally or remotely, or as a combination of each.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The present invention allows an individual to purchase a desired amount of postage at a location remote from a postal metering device, such postage being electronically transmitted to the individual nearly instantaneously upon demand. In a preferred embodiment the user invokes a first processor-based system (PC) to request and receive postage via a program, hereinafter referred to as the "Demand" program, stored on the first PC. The Demand program requests input from the user, coupled devices, or processes about the weight of the item to be mailed, the destination address, etc. The Demand program utilizes the input information to calculate the amount of desired postage for an item to be mailed. A demand for postage is then made to a remote metering system. This postage is to be subsequently printed by the first PC on an envelope, label or letter through a printer or special purpose label maker coupled to the first PC.

It should be understood that the Demand program, in addition to its unique process of creating a postage demand and subsequent printing of postage indicia, also may incorporate information processing modules common in the art. Such a processing module may be a data communications program for establishing and/or maintaining a link between the first and second PCs. Additionally, the Demand program may include an encryption module utilizing cryptographic key sets, hereinafter called postal purchase keys (PPK), for encrypting postage demands and decrypting the received data packet. Such processes are well known in the art and will not be discussed in detail in this specification.

The PPK may be distributed to the first PC in any number of ways. Since the PPK provides means by which a PC may decrypt a received data packet, it is advantageous to distribute such PPK by reliable secure means. One way to distribute the PPK is to provide them with the Demand program. An alternative means of distribution is by recording the PPK on a portable memory means such as, for example, a computer readable disk or a touch memory utility button (TMU), as disclosed in the above U.S. Patent and referenced co-pending application, hereby incorporated by reference, and transmitting it by the mail.

The Demand program demands the postage from a remote postage metering device physically located away from the first PC. In the preferred embodiment the remote postage meter is itself a second PC, typically located at a postage provider's office. The remote postage meter stores a program, hereinafter referred to as the "Meter" program, which verifies postage demands and enables the Demand program to print the desired postage indicia by the transmission of a data packet.

Figure 1:
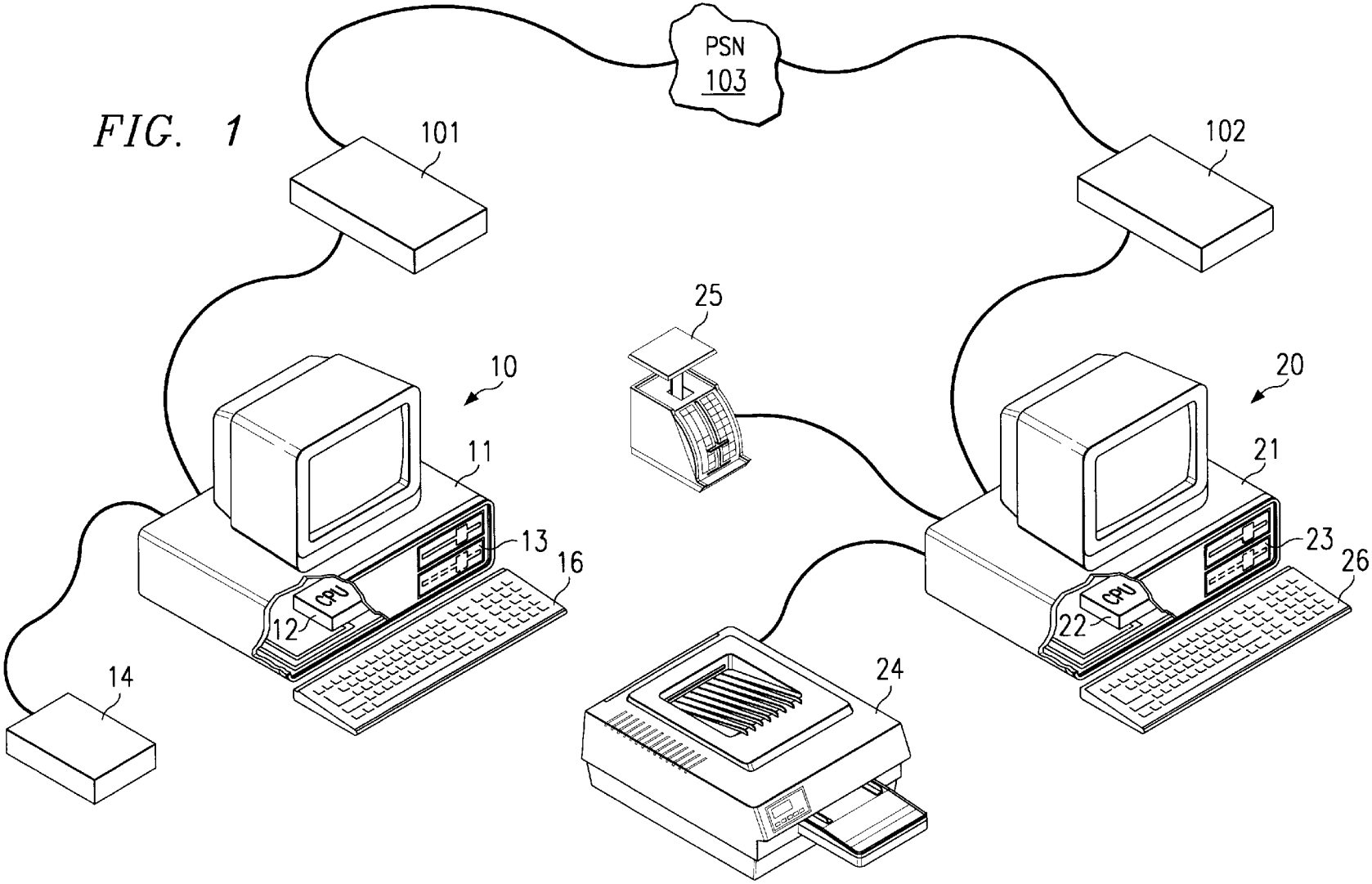
FIG. 1 illustrates processor-based systems of the preferred embodiment of the present invention.

Referring to FIG. 1, there are illustrated processor-based systems 10 and 20 utilized in the preferred embodiment of the present invention. Specifically, PC 10 is utilized to implement the aforementioned Meter program and PC 20 is utilized to implement the Demand program. PC 10 includes chassis 11 enclosing processor (CPU) 12 and disk drive 13 and includes keyboard 16. Likewise PC 20 includes chassis 21 enclosing CPU 22 and disk drive 23 and includes keyboard 26. PCs 10 and 20 are general purpose computers, such as an IBM compatible (or Apple Macintosh) controlled by any general purpose operating system such as DOS or UNIX. It should be noted that PCs 10 and 20 may be computers of differing types and/or controlled by differing operating systems. Furthermore, PC 10 is adapted for receiving postal credit through a receiving device 14.

PC 20 may advantageously be coupled to a receiving device such as receiving device 14 depicted coupled to PC 10. The use of such a receiving device would facilitate the use of a portable memory device to transmit the PPK utilized by the invention. It will be appreciated by those skilled in the art that the use of a portable memory device to store the PPK allows for both the transmittal of the PPK from a postage supplier to the user by a known trustworthy means. Furthermore, by having the ability to removably couple the PPK to PC 20, added security is accomplished by the simple removal of the portable memory device and thus the PPK.

Postage credit to be distributed to demanding PCs is not initially input into PC 10, but rather the amounts of postage credit transmitted to ones of PC 20 are recorded at PC 10. Thereafter, the postal authority, through which the transmitted postage credit is to be utilized, is compensated by the postage provider. However, where a postal authority has not authorized a postage provider to distribute postage credit without first compensating the postal authority, it may be advantageous to utilize a receiving device such as a modem (not shown) whereby direct communications to a postal service may be utilized to receive postal credit. Alternatively, a receiving device, such as receiving device 14, suitable for coupling PC 10 with a TMU button containing an information record of prepaid postage credit may be utilized.

Still referring to FIG. 1, it can be seen that PCs 10 and 20 may be linked together through Public Switched Network (PSN) 103 via modems 101 and 102. PSN 103 may be comprised of any number of now existing or later to be developed communications means. In the preferred embodiment, PSN comprises public telecommunications lines and switching equipment. Alternatively, PSN 103 comprises digital communication over the Internet or similar wide area public gateway. Additionally, PCs 10 and 20 may be linked directly through digital telecommunications trunks (not shown) or through a digital network system cable system, or satellite system (all not shown). It shall be understood that in utilizing a digital network system to link PCs 10 and 20 that modems 101 and 102 are replaced by network interface cards (NIC) or other digital communications devices, e.g., ISDN. It will be appreciated by those of skill in the art that any network linking PCs 10 and 20 may either be secure or not depending on the degree of postage credit transmission security desired.

With further reference to PC 20 illustrated in FIG. 1, printer 24 and balance 25 are depicted. Printer 24 is coupled to CPU 22 and provides printing means for the postage indicia and is, of course, optional if printing of the postage indicia is not desired. Balance 25 is also coupled to CPU 22 and provides automated input of the weight of a postal item into the Demand program. Of course, balance 25 is optional, and input of postal item weight may be accomplished manually by an operator or automatically from a coupled process, such as a word processor, if desired.

Figure 2:
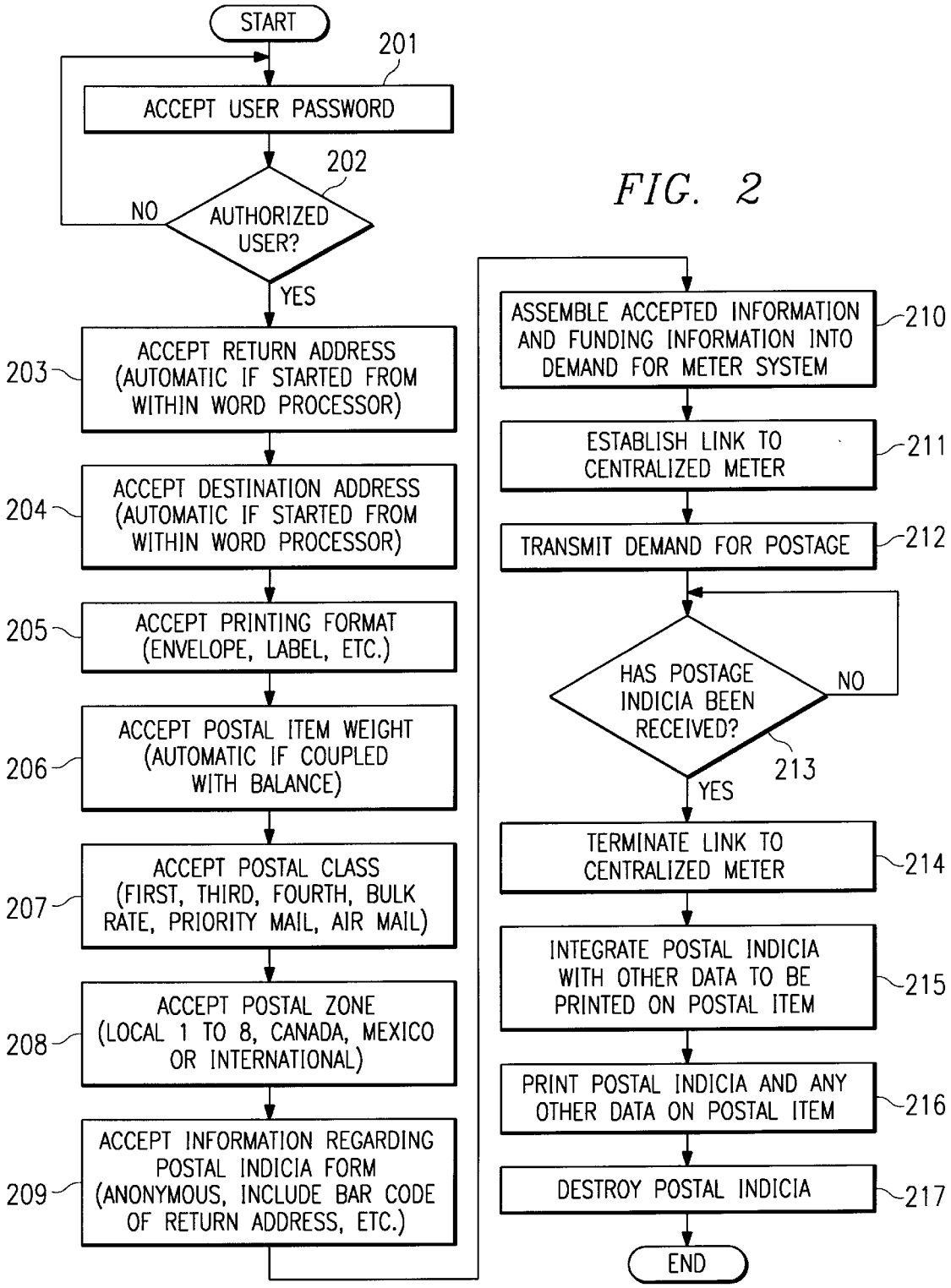
FIG. 2 illustrates a flow diagram of the demand process of the present invention.

Directing attention to FIG. 2, a flow diagram of the preferred embodiment of the Demand program is depicted. Upon activation of the Demand program, the user is asked for, and the process accepts, a user password (step 201). At step 202, the Demand program determines if the accepted password is valid. If the password is not valid, the process returns to step 201, thus preventing unauthorized access to postage. If the password is valid, the process continues to step 203.

Of course, password acceptance and verification steps 201 and 202 may be eliminated, thus providing no password security for the process if desired. Alternatively, password acceptance and verification steps 201 and 202 may be accomplished at a different point in the process than illustrated in FIG. 2.

At step 203 the Demand program accepts the postal item sender's return address. As indicated in step 203, the return address may be communicated to the Demand program automatically if the Demand program is coupled with another process, such as a word processing program. Furthermore, the return address information may be utilized by the Demand program to later print the return address along with the postage indicia on a postal item. If determined to be advantageous, such as, for example, if required by a postal authority, the return address information may also be transmitted to the remote postage metering system for inclusion in a generated data packet or for validation of the postage demand. The return address information can also be encoded within a generated postage indicia in such a way as to be machine readable and thus suitable for utilization in preventing postal fraud.

Alternatively, return address acceptance step 203 may be eliminated if desired. Specifically, where anonymous postage indicia is desired, acceptance of return address information is not necessary to the generation of acceptable postage indicia.

At step 204 the Demand program accepts the postal item destination address. As indicated in step 204, the address may be communicated to the Demand program automatically if the Demand program is coupled to another process such as a word processing program. The address information may be utilized by the Demand program to later print the destination address along with the postage indicia on a postal item. Moreover, the destination address information may also be transmitted to the remote postage metering device for inclusion in a generated data packet or for validation of the correct address. Of course, address acceptance step 204 may be eliminated if desired.

At step 205 the Demand program accepts printing format information to be utilized when ultimately printing the postage indicia. Such formats may include predefined sizes of envelopes and labels as well as user defined items. The Demand program uses the format information for adjusting the postage amount for the size of the postal item as well as for determining the size of postage indicia to be printed. In addition, the printing format information may also be utilized by the remote metering device for such purposes as determining what information to include in a generated data packet. Printing format acceptance step 205 may be eliminated if desired.

At step 206 the Demand program accepts the postal item's weight. As indicated in step 206, the weight may be communicated to the Demand program automatically from a balance in data communication with the Demand program. Of course, the Demand program may also accept weight information through other means, such as keyboard 26.

However, weight information may also be calculated by the Demand program from other information, thus eliminating the need for any direct input of weight. For example, information regarding the printing format, such as accepted in step 205, as well as specific document information, such as is generally available in word processing or other applications, may be utilized by the Demand program to determine the weight. In example, the Demand program weight determination may use information regarding the size and number of pages as well as the context of the document, such as word processing draft, from a coupled word processor in combination with the aforementioned printing format.

It shall be appreciated, simply by knowing the size and number of pages of correspondence, that generally a very close approximation of the required postage may be calculated based on a standard or common paper weight and envelope size. However, this approximation may be made more precise by inputting information regarding the specific envelope or container to include the correspondence, such as may be determined from the above accepted printing format or may be input directly in a step not shown. Additionally, the precision of the postage determination may be increased by the input of the actual paper weight to be used by the correspondence. This information may be provided by a manual input step (not shown) or may be determined automatically, such as from information as to the context of the document provided by the coupled application.

It shall be appreciated that a user may assign certain paper weights and/or sizes to particular document contexts either within the Demand program (not shown) or within a coupled application. For example, correspondence quality printing from a word processor may be associated with 20 pound bond paper, whereas draft quality printing from the same word processor may be associated with 15 pound paper. Similarly, printing of invoices or statements from an accounting program may be associated with two parts, or two copies, of 15 pound paper. Of course, paper size as well as print quality may be supplied by the coupled process or may be manually input. Thereafter, this information may be utilized by the Demand program to precisely determine the weight, and therefore the proper postage required to post such items, without the need to either weigh the postal item or input its weight.

Preferably, the weight information, or information used in its determination, is utilized by the Demand program in the automatic calculation of the necessary amount of postage for the postal item. However, this information may instead be transmitted to the remote postage metering device for inclusion in a generated data packet or for calculation of the necessary amount of postage.

At step 207, the Demand program accepts the postal item's postal class. The class information is utilized by the Demand program in the automatic calculation of the necessary amount of postage for the postal item. Optionally, the postal class information is transmitted to the remote postage metering device for inclusion in a generated data packet.

At step 208, the Demand program accepts the postal item's postal zone. The zone information is utilized by the Demand program in the automatic calculation of the necessary amount of postage for the postal item. Optionally, the postal class information is transmitted to the remote postage metering device for inclusion in a generated data packet.

If desired, postal item weight acceptance or determination step 206, postal class acceptance step 207, and postal zone acceptance step 208 may be replaced by a step simply accepting a desired postage amount.

At step 209, the Demand program accepts postage indicia information to be utilized by the remote metering device when generating a data packet. Such information may include indicating the desire for anonymous postage indicia or inclusion of return and/or destination address in machine readable format to be contained within the printed postage indicia. It shall be appreciated that the postage indicia information may not only be utilized by the remote metering device in generation of a data packet, but may be utilized by the Demand program when printing the postage indicia on a postal item. Postage indicia information acceptance step 209 may be eliminated if desired.

Steps 203 through 209 are not illustrated in this sequence because of any limitation of the present invention, and may be performed in any order with respect to each other according to the present invention.

Subsequent to accepting information, the Demand program assembles predetermined portions of this information into a demand which is of a format suitable for communication to, and acceptance by, a remote metering device (step 210). Preferably, assembly step 210 includes the substeps of determining what information the user desires to be included in the generated postage indicia, determining if an accompanying bar code is desired, and if so, determining what information is to be included therein, and determining the amount of postage the postage indicia should indicate. These substeps provide means by which the Demand program creates a demand for postage suiting the user's needs and desires without the need to transmit superfluous data across PSN 103. Reducing the data transmitted in the demand to only that which is necessary to generate the desired postage indicia serves to reduce the communication time necessary to transmit the demand. This in turn reduces the cost involved in the transmittal, as the communication link may be maintained for a shorter time as well as the user being idle for a shorter time while waiting on transmission and response.

Certain data stored within PC 20 is also included within the demand. Such data includes a public encryption key from the PPK. It is well known in the art that information encrypted using a public encryption key is only decryptable using a corresponding, and presumably private, decryption key. Therefore, the public key of the PPK included within the demand corresponds to a private decryption key of the PPK held at PC 20. Inclusion of a public encryption key within the demand, facilitates the encryption by the metering system of a generated data packet so that it might only be meaningfully utilized at the demanding PC holding the private decryption key.

Additionally, data included within the demand includes a method of funding the transaction and a serial number contained within the Demand program or other unique data. The included serial number or unique data is utilized by the remote metering device for validation of the demand. Of course, inclusion of additional information within the Demand program may be eliminated if desired.

It shall be appreciated that information indicating a method of funding the transaction may be stored within system 20, such as on disk drive 23, to be included within the demand by the Demand program. Similarly, such information may be incorporated into the Demand program itself, such as, for example, where a debit or deposit account is established with the postage provider at the time of initializing the Demand program. Of course, an additional information acceptance step (not shown) may be added to the Demand program whereby the user inputs information regarding the funding of the postage demand.

Assembly step 210 includes the use of an encryption process to encrypt the demand which is to be sent via PSN 103. Subsequent to the assembly of the demand, the Demand program initiates a public key encryption process well known in the art to encrypt the demand. Therefore, meaningful use of the encrypted demand may only be accomplished by decrypting the demand with a private key available only to the remote metering device. Of course, this encryption substep may be eliminated if desired.

Subsequent to assembling the demand, the Demand program establishes a link between PCs 20 and 10 (step 211). The link established in step 211 is a link suitable for data communications between PCs 10 and 20, such as PSN 103 illustrated in FIG. 1. In the preferred embodiment, linking step 211 includes the substeps of dialing a data communications access phone number, providing information as to which resource available through the data communications access is to be utilized, and verifying that data communications with a remote metering system has been accomplished.

Establishing a link between PCs 10 and 20 may be accomplished at a point in the process other than that illustrated in FIG. 2. It is advantageous to utilize as temporally short of communications link as possible in situations where there is a time dependent charge involved for maintaining such links. However, there is no limitation of the present invention to establish and terminate the communications link. For example, where digital telecommunications trunks (not shown) or a digital network system (not shown) are utilized for linking PCs 10 and 20, a data communication link may advantageously be maintained for extended periods of time.

Upon establishing the link in step 211, the demand is transmitted to PC 10 (step 212). The Demand program then monitors the link for receipt of a returned data packet at step 213, returning to step 213 if no postage indica has yet been received. After receipt of the data packet the link between PCs 20 and 10 is terminated (step 214). However, as discussed above, there is no limitation requiring termination step 214 to be accomplished at all or in the order depicted in FIG. 2.

Step 215 involves integrating the data packet with any other data to be printed on the postal item. A substep of decrypting the received data packet, utilizing a private key of the PPK held at the demanding system, is utilized if encryption is desired. Decryption of the data packet near the time of printing the postage indicia is advantageous in preventing postal fraud accomplished by multiple uses of a single data packet. However, decryption may be accomplished at any time prior to printing the postage indicia. Of course, step 215 may be omitted if integration with other data or encryption is not desired.

It shall be understood that as an alternative, or in addition, to the use of encryption in the transmission of the data packet, a system wherein the transmitted data packet only contains information sufficient to enable the forming of a portion of the desired postage indicia may be used if desired. Such a system provides added security by requiring the receiving PC to generate, or otherwise match, the remaining portion of the postage indicia in a form so as to complete the transmitted portion of the indicia. In a preferred embodiment, the Meter program selects the portion of postage indicia to transmit based on a record of past demands by the particular Demand program. Likewise, the Demand program selects the remaining portion of a postage indicia to print based on a similar record of past demands. It will be appreciated that it is very unlikely that any PC, intercepting the transmission of the demand or the resulting data packet, would be able to predict the correct content of the remaining portion of a postage indicia to be printed. Therefore, an extra measure of security against rogue use of the postage indicia is afforded by such a system.

The data integrated with the data packet by step 215 may include sender's return address, destination address, or postal instructions, such as class of mail or special handling instructions. Where the Demand program is coupled with another process, such as a word processor, spreadsheet, accounting, database, or graphics program, the other data may include an entire document created by this other process. An advantage realized by the inclusion of other data with the data packet at time of printing is that hand addressing or multiple printing of postal items is not necessary to imprint both postage indicia or any other information.

At step 216, the Demand program causes PC 20, in conjunction with printer 24, to print the postage indicia and any integrated data upon a postal item. Step 216 utilizes portions of the information accepted at steps 203 through 209 to produce a printed result suitable for the user's needs and desires. Printing format information accepted at step 205 is utilized to determine the size, format, and placement of the printed postage indicia. Moreover, depending on user preference, other information, such as postal class, may also be included on the postal item as printed.

The process of the Demand program concludes with the destruction of the data packet upon successful printing of the postage indicia on a postal item (step 217). Preferably, the Demand program monitors PC 20 for errors associated with an unsuccessful print process before destroying the data packet. Alternatively, the Demand may query the user as to the success of the printing process.

Destruction of the data packet is advantageous in discouraging postal fraud, but is not required by the present invention. As discussed above, the postage indicia itself may include machine readable information to aid in the detection of postal fraud. Such information may include return address, destination address, date, time, or unique information such as the Demand program serial number or a transaction number. This machine readable information could be utilized by the postal service to detect postal fraud by such indicators as destination address on the postal item and encoded within the postage indicia not matching.

Furthermore, including a unique transaction number within the printed postage indicia aids in the detection of postage fraud. This unique transaction is machine readable, and upon two occurrences of the same transaction number, postage fraud is indicated. Moreover, a transaction number may be generated so as to indicate the remote postage metering device that originally distributed the postage credit. With this information, determination of the demanding PC is a simple process of reviewing transaction logs at the remote metering device.

Upon completion of the steps illustrated in FIG. 2, the Demand program may either terminate its execution, thus returning control of PC 20 to another process, or return to an earlier step to continue the process again. It shall be understood that, although the foregoing discussion disclosed the demand for a single postage indicia, multiple ones of the postage indicia may be demanded in any session. Such multiple demands are advantageous in situations where a large amount of mail requires postage. These situations often present themselves in a business environment.

Figure 3:
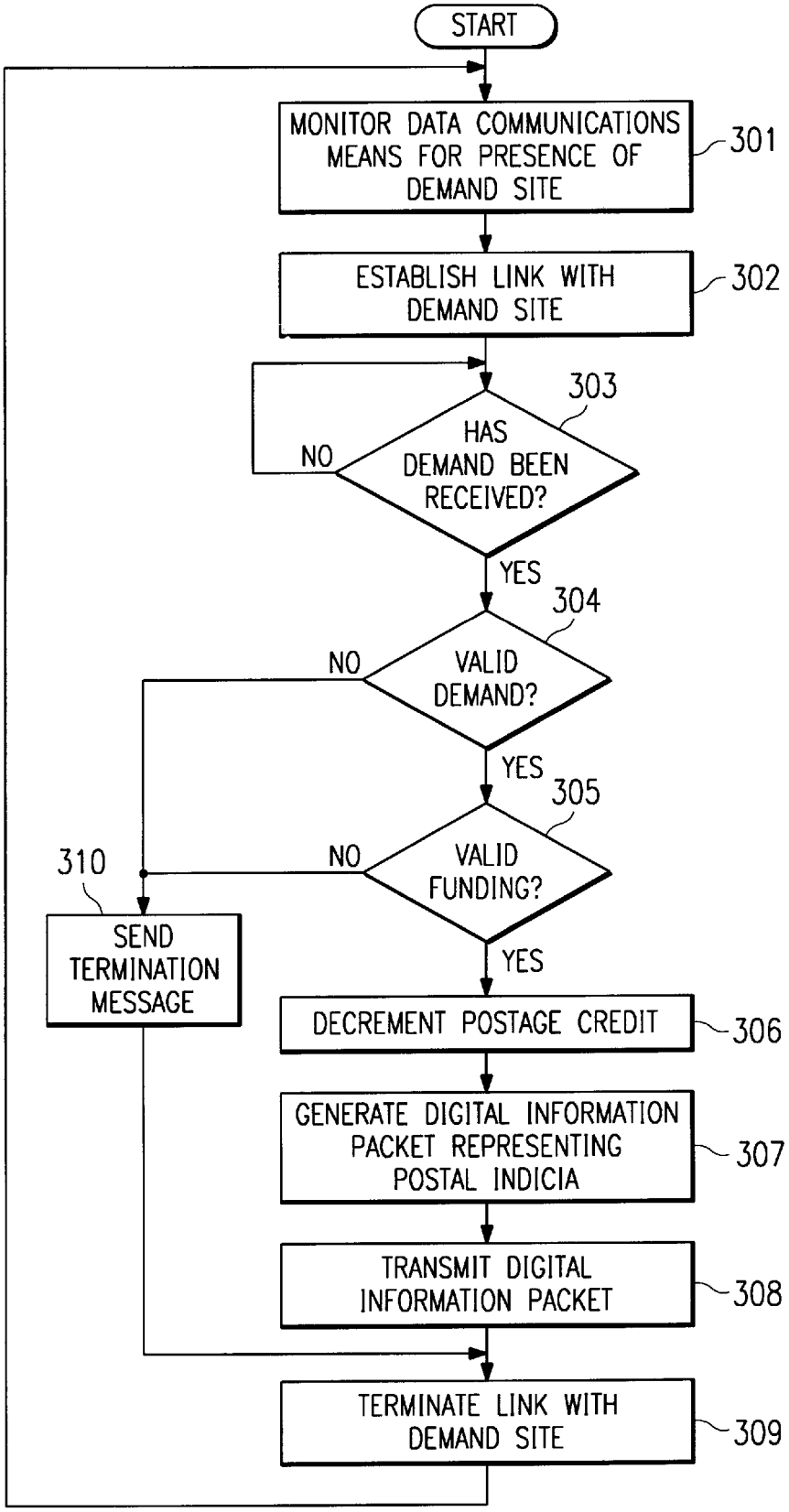
FIG. 3 illustrates a flow diagram of the meter process of the present invention.

Having explained in detail the Demand program of the preferred embodiment of the present invention, attention is directed to FIG. 3, wherein a flow diagram of the preferred embodiment of the Meter program is depicted. Upon execution of the Meter program, data communications are monitored for the presence of a demand site (step 301). When the Meter program detects the presence of a demand site, a link capable of data communication is established at step 302. As discussed in association with the Demand program, establishing a link between PCs 10 and 20 may be accomplished at a point in the process other than illustrated in FIG. 3. For example, in an alternative embodiment, where digital telecommunications trunks (not shown) or a digital network system (not shown) are utilized for linking PCs 10 and 20, a data communication link may advantageously be maintained for extended periods of time.

Subsequent to establishing a data communications link, the Meter program accepts a demand transmitted from a demand site (step 303), returning to step 303 if no demand has yet been received. Accepting a demand includes the substep of decrypting the demand utilizing a decryption key available at PC 10 where encryption of the demand is used.

At step 304, the Meter program validates the demand and, if found valid, proceeds to step 305. Validation is accomplished by verifying selected information contained within the demand against validation data available at PC 10. Data unique to the demand site, such as the Demand program's serial number or the Demand program's communication link address (e.g., telephone number, Internet address, or E-Mail address), is utilized in verification step 304. An advantage of the verification process is that added system security is realized as a result of reducing the possibility of a rogue being able to independently create a valid demand. Of course, where rogue demands for postage are not a concern, validation step 304 may be eliminated.

It shall be understood that encryption of the demand and validation of the demand may be used in the disjunctive or the conjunctive to achieve a desired level of security. Furthermore, as discussed above, the transmission of a partial postage indicia may also be utilized to provide security against unauthorized use of postage indicia.

If it is determined that a demand is invalid, a termination message explaining the reason for denying the demand is transmitted to the demanding site at step 310. Thereafter, the Meter program terminates the data communication link between systems PCs 10 and 20 (step 309) and begins monitoring the data communications device for the presence of a demand site. However, where it is advantageous to maintain the data communications link between PCs 10 and 20, the determination of an invalid demand will not result in termination of the data communications link. Instead, the Meter program sends a message indicating the cause for denial (step 309) and then again monitors for demands (step 303).

At step 305, the Meter program uses funding information found within the demand to determine if proper funding is available for the transaction. Funding for the postage demanded may be accomplished in various ways. The user of the on-demand postage system may have a credit or debit account with the postage provider or may utilize point of sale funding methods such as a valid bank card account. Use of credit and debit accounts require the user to supply the postage provider with certain information prior to the postage demand. In the case of a credit account, the user may be periodically billed for postage previously demanded. In the case of a debit account, the user prepays for postage to be demanded in the future. Upon making demands for postage, costs of the transaction are deducted from the user's debit account. In the case of a bank card account being utilized, the provider will demand payment from the bank card company concurrent with the postage demand. In some situations, credit could be maintained at the local site and transmitted with the indicia request.

Funding the transaction may involve both the amount of the postage necessary to post the postal item and a charge by the postage provider for the on-demand postage service. Accordingly, the amount of the postage is determined by the Demand program by utilizing available information, including the postal item weight, in conjunction with postal rate information maintained in a database stored on disk drive 23 within PC 20. Alternatively, the amount of postage may be determined by the Meter program by utilizing information within the demand, including the postal item weight or information sufficient for its determination, in conjunction with postal rate information maintained in a database stored on disk drive 13 within PC 10. Of course, the amount of postage may also be input directly by the user making the demand if desired.

If it is determined that proper funding is not available, a termination message explaining the reason for denying the demand is transmitted to the demanding site at step 310. Thereafter, the Meter program terminates the data communication link between PCs 10 and 20 (step 309) and begins monitoring the data communications device for the presence of a demand site. Where it is advantageous to maintain the data communications link between PCs 10 and 20, the determination of lack of proper funding will not result in termination of the data communications link. Rather, the Meter program sends a message indicating the cause for denial (step 309) and then again monitors for demands (step 303).

Upon determination of proper funding, the Meter program increments a record of the amount of postage credit transmitted for later compensation to the Postal Authority. Alternatively, the Meter program deducts the amount of postage to be used by the postage indicia from a postage credit available at PC 10 (step 306). The Meter program may itself be provided with postage credit through such means as authorization by an official postal service, direct connection to a postal service office, or portable electronic postage credit. The details of the provision of postage credit to the Meter program is not shown, but may be, for example, the system shown in above referenced and incorporated U.S. Pat. No. 5,510,992.

The Meter program may check the destination address included in the demand to verify that it is a proper address if desired. Address checking is accomplished by comparing the destination address to a database of addresses stored, for example, on disk drive 13 within PC 10.

The Meter program utilizes information contained within the demand to generate a data packet representing the desired postage indicia (step 307). The data packet includes information required of a valid postage indicia by a postal service. Such information may include the date of posting, the amount of the postage, a unique transaction identifier, and identification of the metering device. The information may also include data to be printed with the postage indicia, such as the sender's return address, at the user's preference.

The data packet is a digital representation or image of the postage indicia to be ultimately printed by the demanding site. Such a representation may be accomplished by any number of graphic image formats well known in the art. Such formats include PDF, JPEG, GIF, POSTSCRIPT, PCL, or any other suitable format of graphics data. It will be appreciated by those skilled in the art that the provision of the data packet in a graphics format provides a form of security as proprietary image generation algorithms may be withheld from public use. When utilizing such a graphic image format, any information that the user desires to be included within the postage indicia must be transmitted to the Meter program for inclusion in the data packet. Of course, the use of a graphic image format is optional and may be replaced by any other suitable means for transferring the postage indicia.

For example, the data packet may be digital information sufficient to enable the Demand program to construct a valid postage indicia image either by completing a portion of a transmitted digital image or by generating a postage indicia using data suitable to enable generation contained in the data packet. This embodiment has the advantage of being bandwidth efficient in that less data is transmitted than when utilizing a complete graphic image and any information to be included in the postage indicia may remain at the demand site. The disadvantage to generating the postage indicia image at the demand site is that the image generation algorithm must be distributed to the users, and is thus more susceptible to unauthorized utilization.

At step 308 the data packet generated from the received demand is transmitted via the data communications link to the demand site. Thereafter, the data communications link is terminated between PCs 10 and 20. However, it shall be understood that, as discussed above, there is no limitation requiring termination step 309 to be accomplished in the order depicted in FIG. 3. Where it is advantageous to maintain the data communications link between PCs 10 and 20, termination step 309 may be accomplished at some time other than upon transmittal of the generated data packet.

Although a preferred embodiment has been disclosed, one of skill in the art will appreciate that the present invention may be accomplished by various other means. For example, rather than using the Demand program at PC 20, a simple e-mail program might be used to transmit the necessary information to a remote metering device. E-mail programs are well known in the art and are capable of providing the encrypted bidirectional information communication desirous in the present invention.

Furthermore, PC 10 may advantageously be a public information server such as a web server on the Internet. Such an implementation of PC 10 is very conducive to an e-mail implementation of PC 20 as discussed above.

Moreover, although the preferred embodiment discloses use of the present invention to transmit postal indicia from a remote metering device, it shall be understood that the present invention may be utilized to transmit any form of indicia. For example, the present invention may be utilized to enable users to purchase event admittance tickets from a remote ticket metering or dispensing system, and to subsequently print acceptable tickets on their general purpose printers. Such a system may be useful in the sporting or transportation industry, for example.

Although the present invention and its advantages have been described in detail, it should be understood that various changes, substitutions and alterations can be made herein without departing from the spirit and scope of the invention as defined by the appended claims.

What is claimed is:

1. A system for obtaining for a first processor-based system a desired amount of postage from a remote metering device via a public network, said first processor-based system comprising:

means for establishing mailing parameters specific to a preselected item of mail;

means for indicating a method of payment from a plurality of methods of payment available to a user of said first processor for a desired amount of postage;

means for creating a demand for said desired amount of postage, said demand comprising selected ones of said mailing parameters in combination with said payment method and including other selected unique data from said first system; and means for controlling the transmission of said demand from said first system to said remote metering device over said public network;

said remote metering device comprising:

means for creating a data packet comprising data formatted as a function of a received demand;

means for ascertaining that the method of payment referenced within said received demand is acceptable by the remote metering device for the specific first processor; and means for transmitting a data packet from said remote device to said first system, said data packet to be utilized in the printing of a postage indicia at a general purpose printer under control of said first system.

2. The system of claim 1, wherein said first system is a general purpose computer.

3. The system of claim 1, further comprising:

means, under control of said remote device, for automatically deducting said correct amount, of postage from a total amount of postage stored in said remote device.

4. The system of claim 1, further comprising:

means, operable on said remote device, for validating said demand as a demand eligible for postage.

5. The system of claim 1, wherein said data packet comprises data suitable to enable said first system to generate said postage indicia.

6. The system of claim 1, wherein the public network comprises a public switch network.

7. The system of claim 1, wherein the public network comprises the Internet.

8. The system of claim 1, wherein the public network comprises transmission via a cable system.

9. The system of claim 1, wherein said data packet comprises graphics data, said graphics data comprising a digital image of at least part of said postage indicia.

10. The system of claim 9, further comprising:

means, operable on said first system, for completing said digital image, said postage indicia comprising the completed digital image.

11. The system of claim 1, further comprising:

means for automatically generating an encrypted message as a function of said mailing parameters entered into said first system, said encrypted message being included in said postage indicia when printed.

12. The system of claim 11, wherein said encrypted message is in a POSTNET zip+4 format.

13. The system of claim 11, wherein said encrypted message is in a two-dimensional bar code.

14. The system of claim 1, further comprising:

means, operable on said remote device, for charging a user of the first processor for the postage indicia to be printed utilizing the data packet.

15. The system of claim 14, further comprising:

means for determining a value of said demanded postage; and means for storing in said remote device a running balance of the value of postage demanded by said first system.

16. The system of claim 14, further comprising:

means, operable on said remote device, for automatically receiving payment for the charge to the user of the first processor.

17. The system of claim 14, wherein said charging means comprises drafting an account associated with said user of the first system.

18. The system of claim 1, further comprising:

means, under control of said first system, for printing said data packet as a postage indicia, said postage indicia being acceptable by a postal system as authorized postage.

19. The system of claim 18, wherein said printing means comprises a general purpose printing device.

20. The system of claim 19, wherein said printing means further comprises:

means for embedding said postage indicia into a document stored in said first system; and means for printing said document including said embedded postage indicia.

21. The system of claim 20, wherein said document stored in said first system is associated with a process operable on said first system, said process selected from the group consisting of a word processor program, a spreadsheet program, an accounting program, a database program, and a graphics program.

22. The system of claim 1, further comprising:

means for automatically calculating a correct amount of postage for said preselected item of mail as a function of said mailing parameters accepted into said first system.

23. The system of claim 22, wherein said calculating means is operable on said first system.

24. The system of claim 22, wherein said calculating means is operable on said remote device.

25. The system of claim 22, wherein said calculating means comprises:

means for determining a weight of said preselected item of mail as a function of information associated with said preselected item of mail.

26. The system of claim 25, wherein said weight determining means comprises:

means for establishing parameters specific to said preselected item of mail, said parameters comprising information exclusive of a weight of said preselected item of mail;

means for establishing a context for a document associated with said preselected item of mail; and means for calculating a weight of said preselected item of mail as a function of said parameters and said context.

27. A method for purchasing a desired amount of postage from a remote metering device, said method comprising the steps of:

accepting mailing parameters specific to a preselected item of mail by a first processor-based system;

creating a demand for a correct amount of postage at said first system, said demand comprising the substeps of:

authorizing payment for said correct amount of postage;

selecting ones of said mailing parameters;

selecting unique data from said first system; and combining said selected mailing parameter, said unique data and said payment authorization;

temporarily coupling said first system to a second processor-based system;

transmitting said demand from said first system to said second system;

creating a data packet at said second system, said data packet comprising data formatted as a function of said demand;

transmitting said data packet from said second system to said first system; and printing said data packet as postage indicia at said first system, said postage indicia being acceptable by a postal system as authorized postage.

28. The method of claim 27, further comprising the step of:

automatically generating an encrypted message as a function of said mailing parameters entered into said first system, said encrypted message being included in said postage indicia when printed.

29. The method of claim 27, further comprising the step of:

said second system verifying said payment authorization included in said demand by said first system.

30. The method of claim 27, further comprising the step of:

validating said demand at said second system as a demand eligible for postage.

31. The method of claim 27, wherein said data packet is in the form of data suitable to enable said first system to generate said postage indicia.

32. The method of claim 27, further comprising the step of:

storing in said second system an account balance associated with said first system.

33. The method of claim 32, further comprising the step of:

said second system automatically deducting said correct amount of postage from said account balance stored in said second system.

34. The method of claim 27, wherein said data packet is in the form of graphics data, said graphics data comprising a digital image of at least part of said postage indicia.

35. The method of claim 34, further comprising the steps of:

completing said digital image, said postage indicia comprising said competed digital image.

36. The system of claim 27, wherein said printing step comprises the substeps of:

embedding said data packet into a document stored in said first system; and printing said document including said embedded data packet.

37. The system of claim 36, wherein said document stored in said first system is initially generated by a process operable on said first system, said process selected from the group consisting of a word processor program, a spreadsheet program, an accounting program, a database program, and a graphics program.

38. The method of claim 27, further comprising the step of:

automatically calculating a correct amount of postage for said preselected item of mail as a function of said mailing parameters.

39. The method of claim 38, wherein said calculating step comprises the substep of determining a weight of said preselected item of mail from ones of said accepted mailing parameters.

40. The method of claim 39, wherein said determining substep comprises the steps of:

establishing parameters specific to said preselected item of mail, said parameters comprising information exclusive of a weight of said preselected item of mail;

establishing a context associated with said preselected item of mail; and calculating a weight of said preselected item of mail as a function of said parameters and said context.

41. A system for obtaining a valuable indicia from a remote metering device under control of a processor-based system, said valuable indicia having a selected value and printable on a document, said purchasing system comprising:

means for temporarily coupling said processor-based system to said remote metering device, said coupling means providing data communications between said processor-based system and said remote metering device;

means, operating on said processor-based system, for demanding said valuable indicia, said demand comprising data indicating a desired amount of said indicia, said demand further comprising data indicating a method of payment for said valuable indicia, said demand being communicated via said coupling means; and means, operating on said processor-based system, for receiving an electronic representation of said desired amount of said valuable indicia from said remote metering device, said received electronic representation being communicated in response to said demand.

42. The system of claim 41, further comprising:

means, operable on said processor-based system, for printing said electronic representation of said desired amount of valuable indicia, said printed indicia having a value accepted by an entity.

43. The system of claim 41, wherein said electronic representation of said desired amount of valuable indicia is in a form of data suitable for said processor-based system to generate a printable valuable indicia.

44. The system of claim 41, wherein said electronic representation of said predetermined amount of postage is in a form of a digital graphic image, said digital graphic image comprising at least part of a printable valuable indicia.

45. The system of claim 41, wherein said demand further comprises:

data to be encrypted by said remote metering device, the encrypted data being included in said electronic representation of said desired amount of said valuable indicia.

46. The system of claim 41, wherein said coupling means comprises information communication selected from the group consisting of:

a public switched network;

a public information communication system;

the Internet;

a cable system; and a satellite system.

47. The system of claim 41, wherein said purchasing systems further comprises:

means for accepting parameters at said processor-based system, said parameters being associated with an item to which said valuable indicia will be affixed.

48. The system of claim 46, wherein said demand further comprises:

select ones of said parameters accepted at said processor-based system.

49. A postage metering apparatus for distributing predetermined amounts of postage indicia to select ones of a plurality of processor-based systems in temporary data communication with said postage metering apparatus in response to purchase demands by select ones of the plurality of processor-based systems, said postage metering apparatus comprising:

means for accepting demands for predetermined amounts of postage from ones of said plurality of processor systems via a temporary data communication between said metering apparatus and a calling one of said processor systems;

means for validating said demands to ensure said ones of said plurality of processor systems are eligible to receive said predetermined amounts of postage;

means for determining a method of payment for said predetermined amount of postage;

means for validating a determined payment method for a specific calling processor system; and means for transmitting an indicia of said predetermined amount of postage to a successfully validated calling one of said plurality of processor systems.

50. The apparatus of claim 49, further comprising:

means for storing an account associated with a particular one of said plurality of processor-based systems;

means for incrementing said account when said particular one of said plurality of processor-based systems demands said predetermined amount of postage.

51. The apparatus of claim 49, wherein said accepted demand further comprises data indicating a method of payment for said predetermined amount of postage.

52. The apparatus of claim 49, wherein said accepted demand further comprises parameters associated with a postal item.

53. The apparatus of claim 49, wherein said accepted demand further comprises data to be included in said transmitted indicia of said predetermined amount of postage.

54. The apparatus of claim 49, wherein said temporary data communication between said metering apparatus and a calling one of said processor systems comprises information communication selected from the group consisting of:

a public switched network;

a public information communication system;

the Internet;

a cable system; and a satellite system.

55. A system for acquiring and funding a correct postage indicia from a remote metering device, said system comprising:

means for temporarily coupling a general purpose computer to said remote metering device;

means, operable on said computer, for generating mailing parameters specific to a preselected item of mail;

means for automatically calculating a correct amount of postage for said preselected item of mail as a function of said generated mailing parameters;

means, operable on said computer, for creating a demand for postage indicia, said demand including selected ones of said mailing parameters in combination with selected unique data from said computer;

means for transmitting said demand from said computer to said remote system for an indicia bearing a specific amount of postage;

means, operable on said remote system, for determining a method of payment for a postage indicia bearing a specific amount of postage as demanded by one of said computers;

means, operable on said remote system, for validating said demand as a demand eligible for a postage indicia of the amount demanded from said computer, said validating means also for validating said method of payment;

means, operable on said remote system, for creating a data packet comprising data formatted as a function of said demand, said data packet operable for controlling the printing of a postage indicia at said temporarily connected computer;

means for transmitting said data packet from said remote system to said computer over said temporary connection; and means, under control of said computer, for printing said data packet as a postage indicia, said printing means comprising a general purpose printing device, said postage indicia being acceptable by a postal system as authorized postage.

56. The system of claim 55, further comprising:

means for storing in said remote system a running balance of value of postage demanded by said computer; and means for adding said specific amount of postage to said running balance stored in said remote system.

57. The system of claim 55, further comprising:

means, under control of said remote system, for storing an amount of postage credit; and means, under control of said remote system, for automatically deducting said specific amount of postage from said stored amount of postage credit.

58. The system of claim 55, further comprising:

means for automatically generating an encrypted message as a function of said mailing parameters entered into said computer, said encrypted message being included in said printed postage indicia.

59. The system of claim 55, wherein said transmitted data packet comprises information representing a graphic image of at least a portion of said correct postage.

60. The system of claim 59, further comprising:

means for determining a matching remaining portion of said correct postage indicia, said printing means using said transmitted data packet so as to create a complete correct postage indicia by matching a portion of said correct postage indicia transmitted in said data packet with the determined remaining portion of said correct postage indicia.

61. The system of claim 55, wherein said transmitted data packet comprises information suitable for enabling said computer to generate at least a portion of said correct postage indicia.

62. The system of claim 61, further comprising:

means for generating a correct postage indicia, said generating means comprising:

means for creating an electronic representation of at least a portion of said correct postage indicia from said information in said transmitted data packet, said electronic representation being suitable for printing by said printing means.

63. The system of claim 62, further comprising:

means for determining a matching remaining portion of said correct postage indicia, said printing means using said electronic representation so as to create a complete correct postage indicia by matching the electronic representation with the determined remaining portion of said correct postage indicia.

* * * * *